US007462770B2

(12) United States Patent
Dunnett

(10) Patent No.: US 7,462,770 B2
(45) Date of Patent: Dec. 9, 2008

(54) HOOP BODY APPARATUS

(76) Inventor: Ronn Dunnett, 4587 57th Street, Delta, BC (CA) V4K 3E4

( * ) Notice: Subject to any disclaimer, the term of this patent is extended or adjusted under 35 U.S.C. 154(b) by 0 days.

(21) Appl. No.: 11/677,996

(22) Filed: Feb. 22, 2007

(65) Prior Publication Data

US 2007/0193432 A1 Aug. 23, 2007

Related U.S. Application Data

(60) Provisional application No. 60/776,621, filed on Feb. 23, 2006.

(51) Int. Cl.
*G10D 13/02* (2006.01)

(52) U.S. Cl. ..... 84/411 R

(58) Field of Classification Search ..... 84/411 R
See application file for complete search history.

(56) References Cited

U.S. PATENT DOCUMENTS

| | | | | | |
|---|---|---|---|---|---|
| 2,667,098 | A | * | 1/1954 | McMullen | 84/414 |
| 2,779,227 | A | * | 1/1957 | Slingerland, Jr. | 84/411 R |
| 3,635,119 | A | * | 1/1972 | Thompson | 84/411 R |
| 3,668,296 | A | | 6/1972 | Criscuolo | |
| 3,883,993 | A | * | 5/1975 | Pullan | 49/490.1 |
| 4,283,985 | A | * | 8/1981 | Famularo | 84/411 R |
| 4,344,349 | A | * | 8/1982 | Cordes | 84/411 R |
| 4,993,304 | A | * | 2/1991 | Lovelet | 84/411 R |
| RE33,685 | E | * | 9/1991 | Andre et al. | 84/413 |
| 5,121,666 | A | * | 6/1992 | Valen | 84/453 |
| 5,261,309 | A | * | 11/1993 | Valen | 84/453 |
| 5,272,952 | A | | 12/1993 | Hoshino | |
| 5,417,136 | A | | 5/1995 | Kralik et al. | |
| 5,450,780 | A | | 9/1995 | Hoshino | |
| 5,834,667 | A | * | 11/1998 | Midkiff | 84/411 R |
| 6,166,311 | A | * | 12/2000 | Barrickman | 84/411 R |
| 6,916,977 | B2 | * | 7/2005 | Hagiwara | 84/411 R |
| 6,953,883 | B1 | | 10/2005 | Jacobson | |
| 7,009,099 | B1 | | 3/2006 | Belli | |
| 7,214,871 | B2 | * | 5/2007 | Hasenmaier | 84/723 |
| 2003/0000366 | A1 | * | 1/2003 | Miller | 84/411 R |
| 2003/0121397 | A1 | * | 7/2003 | May | 84/411 R |
| 2007/0193432 | A1 | * | 8/2007 | Dunnett | 84/411 R |
| 2008/0041215 | A1 | * | 2/2008 | Wang | 84/411 R |

* cited by examiner

*Primary Examiner*—Walter Benson
*Assistant Examiner*—Robert W Horn
(74) *Attorney, Agent, or Firm*—Michael F. Hughes; Hughes Law Firm, PLLC

(57) ABSTRACT

A composite drum hoop. The composite drum hoop has a first body section. The first body section is configured to attach to a drum. A second body section attaches to the first body section. The second body section is arranged on the circular rim of the first body section to preserve the circular rim from a drumstick impact.

18 Claims, 2 Drawing Sheets

HOOP BODY APPARATUS

RELATED APPLICATIONS

This application claims priority benefit of U.S. Ser. No. 60/776,621, filed Feb. 23, 2006.

BACKGROUND

U.S. Pat. No. 6,166,311 discloses a drum hoop with protective edge. As seen in the Summary of the Invention section in column 2 around line 7, "The drum hoop of the present invention proposes to correct the deficiencies of the prior art drum assemblies by providing an inwardly directed edge to cover the bearing edge of the drum shell." Further at line 12, "The drum hoop . . . has an inwardly directed edge which partially or substantially covers the top most bearing edge of the drum shell through the use of a rim which is beveled or which slightly tapers at its innermost point. The drum hoop serves to prevent damage to the bearing edge while also tensioning the drumhead to the drum shell."

U.S. Pat. No. 5,261,309 discloses a wear pad assembly attachable to a drum structure. As seen in the Summary of the Invention section in column 1 around line 35, "The present drumstick wear pad assembly is attachable to a drum rim, and includes a nonmetallic relatively hard pad outwardly above the rim, the mount configured to be attachable to the drum structure in spaced relation to the rim." Further down in the same column 1 around line 49, "The pad itself may advantageously consist of hard leather, closely acoustically coupled to the mount which is metallic and acoustically coupled to the rim, whereby drumstick striking of the pad transmits shock waves to the metallic rim to produce "rim shot" acoustic effect."

U.S. Pat. No. 4,344,349 discloses a rim shot segment. As seen in the Summary of the Invention section in column 1 around line 33, "The present invention provides a new and improved arrangement for substantially eliminating all damage to drumsticks as a direct result of the rim shot technique while producing a more mellow, pleasant sound." Further at line 37, "The present invention provides an attachment for a drum in the form of an arcuate segment of plastics material adapted to be secured with the drum head between the drum shell and drum hoop with the segment disposed in contact with the drum head and the inner circumferential surface of the hoop while extending above the hoop so as to prevent contact of the drumsticks with the metal hoop."

EMBODIMENTS

Figure 1A:
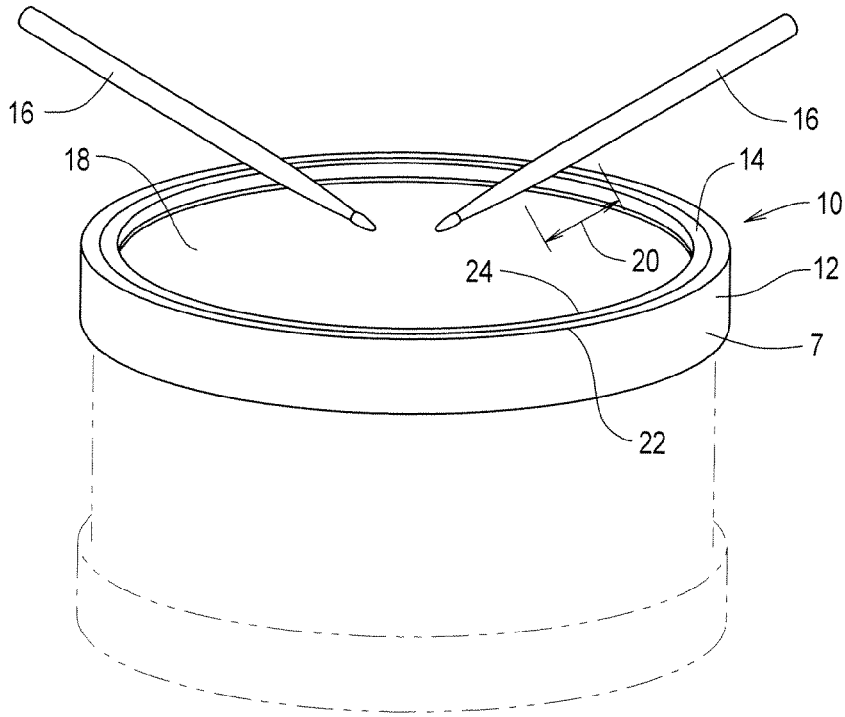
FIG. 1A is a perspective view of the hoop body.

Referring to FIG. 1A, a hoop body impact protector 10, is provided to reduce wear and tear on hoop bodies 12 as well as to prevent wear and tear to the drumsticks 16 when the drumsticks 16 impact the inner hoop body radius corner 24 of the hoop body 12, the impact occurring within a stick impact zone 20. The hoop body itself can be constructed of various materials, including metal, wood, plastic or rubber; in one particular embodiment the hoop body is constructed of a laminated wooden ply construction, in an alternate construction it is a natural wood material.

The hoop body impact protector 10 and the hoop body 12 combine together to form a composite drum hoop 7. In general, the composite drum hoop has a first body section and a second body section. The first body section is the hoop body 12, and the second body section is the impact protector 10. Generally speaking, the first body section is arranged to attach to the drum, and the second body section is arranged to attach to the first body section.

Figure 2:
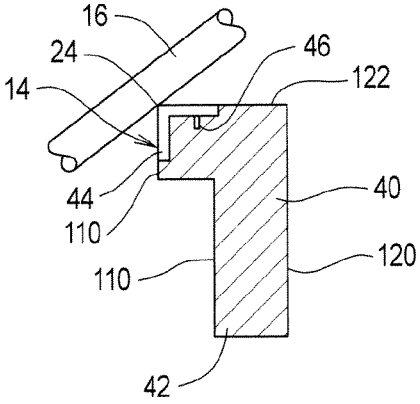
FIG. 2 is an elevational sectional view of the impact guard.
Figure 3:
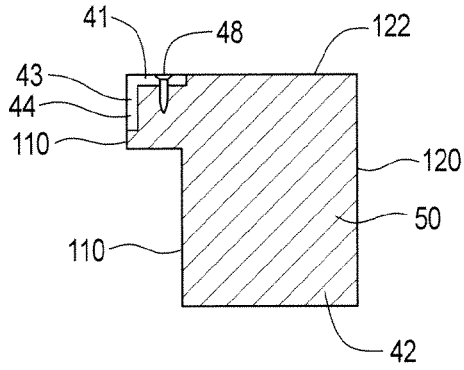
FIG. 3 is an elevational sectional view of an alternative embodiment of the impact guard.

In most drum construction, the hoop body or first body section is a circular rim. The rims match the drum size and vary in diameter or radius depending on the size of the drum. Furthermore, the hoop body has a cross-sectional arrangement which also depends on the type of drum being used. For example, the hoop body 12 can be used for a snare drum, a bass drum or a tom-tom. The cross-section, as seen in FIGS. 2 and 3, can also vary. A narrow top hoop body 40, as seen in FIG. 2, is provided which has a narrower profile. A wide body hoop 50, as seen in FIG. 3, is also shown which has a wider profile than the narrow hoop body 40, as seen in FIG. 2. The narrow top hoop body section 40 and the wide top hoop body section 50 both have inner radial surfaces 110 and outer radial surfaces 120. Furthermore, each hoop body section has a top surface 122. Much of the impact will occur towards the inner radial surface on the top surface 122 of the various rims.

A first embodiment of the impact protector 10, as seen in FIG. 1A, is arranged to provide for protection of the hoop body 12 within the inner hoop radius 24. Here the entire interior circumferential edge of the hoop radius 24 is covered by the impact protector 10. In other words, a circular edge coverage is provided by the impact protector 10 in this first embodiment. In an embodiment where the hoop rim is made of a wooden construction and the impact protector 10 is constructed of a metallic material such as brass, the striking of the impact protector 10 with the drumsticks 16 creates a pleasing high frequency sound or rim shot.

Figure 1B:
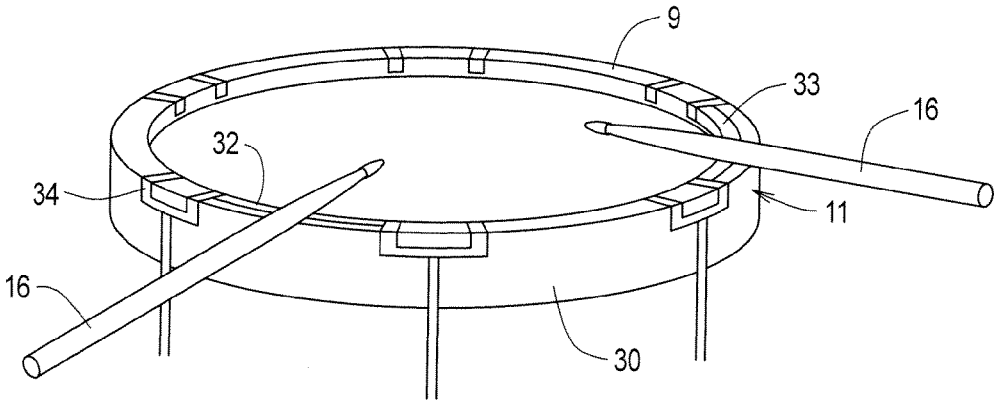
FIG. 1B is a perspective view of an alternative embodiment of the hoop body.

A second embodiment of the impact protector 10, as seen in FIG. 1B, provides for a localized hoop body impact protector 11. The localized impact protector 11 essentially covers a portion of the circular edge coverage as indicated above, or in other words creates an arcuate edge coverage. This arcuate edge coverage can include a first arc or first partial circumferential impact guard 32, as well as a second arc or second partial circumferential impact guard 33.

In the bass drum embodiment, as seen in FIG. 1B, the partial impact guards are used to bridge between bass drum hoop claws 34 of the top hoop 30 of the bass drum. The bass drum top hoop body 30 in this embodiment is of a wooden construction. The hoop claws 34 connect together via the partial circumferential impact guards 32 and 33. Therefore, the user can place the partial circumferential impact guards 32 and 33 strategically about the circumference of the bass drum hoop body 30 so that the drum sticks 16 do not impact the top face 9 of the hoop body 30, thus preventing damage to both the hoop body and the drumsticks over long periods of use.

Referring to FIG. 2, one form of the impact guard 14 is provided on the inner radius 24 of a narrow wooden top hoop body 40. The impact guards 14 themselves are constructed of materials which have a high resistance to repetitive impacts; these types of materials include brass, steel, aluminum, carbon fiber, fiberglass, and rubber products such as butyl rubber or natural rubber. Other materials which would provide for lengthening of the life of the wooden hoop drum top body 12 (as seen in FIG. 1) would also include the use of plastics or polyvinyl chlorides fashioned in such a manner that the impact of the drumsticks 16 on the wooden hoop 12 would be minimized and the wooden top hoop 12 would be preserved while still enabling its aesthetic and musical characteristics.

Generally speaking, the protector cross section is arranged so that it can cover the top surface 122, as seen in FIG. 2, of the circular rim. The top surface 122 may be the top surface of a rectilinear shape, a circular shape, an oval shape, or any geometric cross sectional shape of the circular rim. While the protector cross section as provided in the embodiments currently provided, matches in some respects the surface of the circular rim, in alternative embodiments the protector cross section may have just one attachment point to the drum. This attachment point may be as indicated above, connected to the drum claws, connected to other portions of the drum structure, or the attachment point may be situated on the circular rim either periodically or continuously.

A discussion of the shapes of the impact guard in cross section will now be provided. While the current shapes in the impact guard are provided in alternative embodiments, it is conceived that the impact guard cross-sectional shape can be arranged in any fashion which provides the desired protection to the circular rim. For example, the impact guard may have a cross section which is circular, oval, rectilinear, non-rectilinear, amoeba like, or any other type of cross-sectional shape which substantially covers the desired protected area on the circular rim. Discussion of some of the alternative embodiments of the impact guard are referred to below.

Referring back to FIG. 2, one form of the impact guard 14 is an L-shaped impact guard 44; this L-shaped impact guard 44 can be attached to the narrow wooden top hoop body for the inner radius 24 by pressing the L-shaped impact guard 44 into the narrow wooden top hoop body 40 in somewhat of a press-on attachment means 46.

Another form of attachment for the L-shaped impact guard 44 would be through the use of (as seen in FIG. 3 a wooden or metal screw attachment 48 which would be attached to the top leg 41 or side leg 43 of the L-shaped impact guard 44. Also, as seen in FIG. 3, the wooden top hoop body 50 is in a wide-body configuration.

Figure 4A:
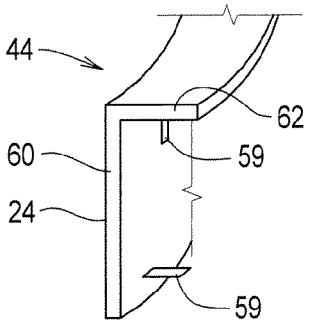
FIG. 4A is perspective detail of the impact guard.

Another embodiment or configuration of the impact guard 14 would be in the arrangement of an L-shaped impact guard 44 as seen in FIG. 4A having a long vertical leg 60 arranged on the inside radius 24 of the wooden hoop body 12. The L-shaped impact guard 44 would also have a short horizontal leg 62. In a further attachment means, the L-shaped impact guard 44 has in this current embodiment plurality of attachment protrusions or attachment tabs 59 which anchor the impact guard to the wooden hoop body.

Figure 4B:
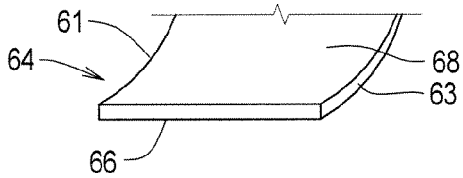
FIG. 4*b* is a perspective detail of an alternative embodiment of the impact guard.

Another form of the impact guard 14 is through the use of a flat bar impact guard 64 as seen in FIG. 4B. This flat bar impact guard 64 is arranged on the top face 9 of the wooden hoop body 12 where the flat bar has a top horizontal face 68 and a bottom horizontal face 66. The flat bar 64 also has an inner radial edge 61 and an outer radial edge 63, each corresponding to the inner hoop radius edge 24 and the outer hoop radius edge 22 of the hoop body 12 respectively as seen in FIG. 1.

Figure 4C:
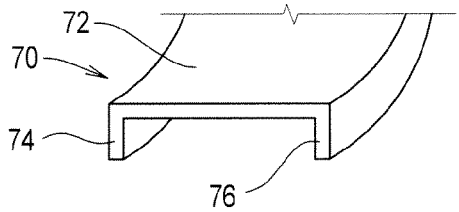
FIG. 4C is a perspective detail of an alternative embodiment of the impact guard.

Another form of the impact guard 14 (as seen in FIG. 4C) is a U-shaped impact guard 70. This particular embodiment has a horizontal top leg 72, a vertical inner radial leg 74 which corresponds to the inner hoop radius 24, and a vertical outer radial leg 76 which corresponds to the outer hoop radius 22.

Figure 4D:
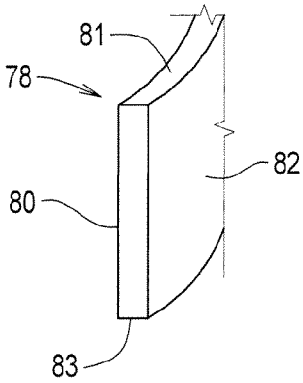
FIG. 4D is a perspective detail of an alternative embodiment of the impact guard.

Referring to FIG. 4D, the vertically aligned flat bar impact guard 78 has an inner radius face 80 and an outer radius face 82, as well as a top face 81 and a bottom face 83. The top face 81 is arranged to take the impact of the drumsticks 16 as previously discussed.

Figure 4E:
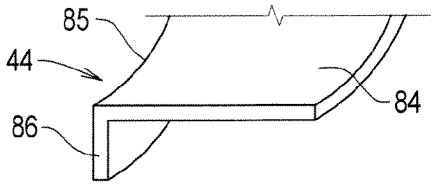
FIG. 4E is a perspective detail of an alternative embodiment of the impact guard.

Another form of the impact guard 14 is an L-shaped guard 44 (as seen in FIG. 4E) which has a long horizontal leg 84 and a vertical short leg 86. The long horizontal leg 84 in this particular embodiment has the origin 85 of the two legs, corresponding to the inner hoop radius 24 of the hoop body.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A composite drum hoop comprising:

a. a first body section comprising a circular rim, said circular rim comprising a cross-section, said first body section configured to attach to a drum;

b. a second body section comprising a first arcuate impact layer, said second body section configured to attach to said first body section;

c. said first body section further comprising a wooden material;

d. said second body section further comprising a metallic material, an attachment means to maintain a connection between said first body section in said second body section;

e. said first arcuate impact layer interoperating with said circular rim and protecting said circular rim from a drumstick impact, said drumstick impact producing an impact sound.

2. The composite hoop drum of claim 1 wherein the second body section covers and is connected to a portion of a top surface of the first body.

3. The composite hoop drum of claim 2 wherein the second body section is substantially planar in cross section.

4. The composite hoop drum of claim 2 wherein the second body section is substantially U-shaped in cross section such that a portion of a inner radius surface, the top surface, and a portion of an outer radus surface of the first body are each protected by the second body section.

5. The composite hoop drum of claim 2 wherein the second body section is substantially L-shaped in cross section.

6. The composite hoop drum of claim 5 wherein the second body section is set within a recess of the first body material such that their adjacent surfaces are substantially continuous.

7. The composite hoop drum of claim 1 wherein said second body section further comprising a metallic material selected from the group consisting of brass, steel, and aluminum.

8. The composite hoop drum of claim 1 wherein said second body section is coupled to said first section by way of screws, adhesives, or attachment tabs.

9. A drum comprising:

a. a circular outer shell;

b. a bottom hoop;

c. a composite top hoop comprising;

i. a first body section comprising a circular rim, said circular rim comprising a cross-section, said first body section configured to attach to a drum;

ii. a second body section comprising a first arcuate impact layer, said second body section configured to attach to said first body section;

iii. said first body section further comprising a wooden material;

iv. said second body section further comprising a metallic material, an attachment means to maintain a connection between said first body section in said second body section;

v. said first arcuate impact layer interoperating with said circular rim and protecting said circular rim from a drumstick impact, said drumstick impact producing an impact sound.

10. A composite drum hoop comprising:

d. a first body section comprising a circular rim, the circular rim comprising a cross-section, the first body section configured to attach to a drum;

e. a second body section comprising a first arcuate impact layer, the second body section configured to attach to the first body section;

f. the first body section further comprising a wooden material;

g. the second body section being comprised of a material having a hardness greater than the wood material of the first body, and an attachment portion being provided to connect the first body section to the second body section;

h. the first arcuate impact layer interoperating with the circular rim and protecting the circular rim from a drumstick impact, the drumstick impact producing an impact sound.

11. The composite drum hoop as recited in claim 10 where the wood material of the first body comprises a substantial portion of the first body having an upper portion where the wood material is positioned.

12. The composite drum hoop as recited in claim 11 where the second body section is comprised of the material harder than the wood material adjacent to the wood material at a portion adjacent to the wood material where a plurality of fasteners connect to the first body section and the second body section.

13. The composite hoop drum of claim 10 wherein said second body section further comprising a hard material selected from the group consisting of brass, steel, carbon fiber, rubber, and aluminum.

14. The composite hoop drum of claim 10 wherein the second body section covers and is connected to a portion of the top surface of the first body.

15. The composite hoop drum of claim 13 wherein the second body section is substantially L-shaped in cross section.

16. The composite hoop drum of claim 15 wherein the second body material is set within a recess of the first body material such that their adjacent surfaces are substantially continuous.

17. The composite hoop drum of claim 10 wherein said second body section further comprising a metallic material selected from the group consisting of brass, steel, and aluminum.

18. The composite hoop drum of claim 10 wherein said second body section is coupled to said first section by way of screws, adhesives, or attachment tabs.

* * * * *